US007207247B1

(12) United States Patent
Kirby

(10) Patent No.: US 7,207,247 B1
(45) Date of Patent: Apr. 24, 2007

(54) HAMMER HEAD WRENCH

(76) Inventor: Lyle L. Kirby, 10340 N. Effingham St., Wheeler, IL (US) 62479

( * ) Notice: Subject to any disclaimer, the term of this patent is extended or adjusted under 35 U.S.C. 154(b) by 0 days.

(21) Appl. No.: 11/516,264

(22) Filed: Sep. 6, 2006

Related U.S. Application Data

(60) Provisional application No. 60/715,338, filed on Sep. 8, 2005.

(51) Int. Cl.
*B25B 13/48* (2006.01)
*B25B 15/00* (2006.01)

(52) U.S. Cl. ..... 81/436; 7/143

(58) Field of Classification Search ..... 81/436; 7/143

See application file for complete search history.

(56) References Cited

U.S. PATENT DOCUMENTS 973,218 A * 10/1910 Schlueter ..... 81/119
1,743,505 A 1/1930 Turgeon ..... 173/93.7
1,761,156 A 6/1930 Rosan ..... 81/436
3,519,087 A 7/1970 Santi ..... 173/91
3,766,811 A * 10/1973 Callahan ..... 81/177.2
3,850,056 A * 11/1974 Allen ..... 81/438
3,861,250 A 1/1975 Zugai ..... 81/464
4,807,349 A 2/1989 Blackmore ..... 29/426.5
4,864,902 A * 9/1989 Doorley ..... 81/466
5,526,722 A 6/1996 Limehouse ..... 81/466
5,906,146 A * 5/1999 Arlen ..... 81/53.2
5,970,552 A 10/1999 Kwiecien et al. ..... 7/143
6,449,789 B1 * 9/2002 Krass et al. ..... 7/143

FOREIGN PATENT DOCUMENTS

JP 05220672 A * 8/1993
WO WO 8302248 A1 * 7/1983

* cited by examiner

*Primary Examiner*—David B. Thomas
(74) *Attorney, Agent, or Firm*—Grace J. Fishel

(57) ABSTRACT

An L-shaped wrench with a handle and a shank attached to a hammer head. The hammer head may be hexahedral with the handle and shank attached to adjacent flats with opposing flats forming impact surfaces for applying an axial force along the handle or shank with an impact device such as a hammer. The remaining two flats provide torque surfaces for application of a secondary force such as a wrench. The handle and shank may be detachable from the hammer head and the hammer head may be relieved for clearance between the flats to which the handle and shank are attached.

4 Claims, 3 Drawing Sheets

HAMMER HEAD WRENCH

This application claims priority from provisional application Ser. No. 60/715,338, filed Sep. 8, 2005, for Hammer Head Wrench.

BACKGROUND OF THE INVENTION

1. Field of the Invention

The present invention relates to a wrench with a hammer head for applying an axial force on a fastener with a recessed head and for simultaneously or subsequently applying a torque to loosen the fastener. The wrench serves both to loosen and remove "frozen fasteners."

2. Brief Description of the Prior Art

L-shaped wrenches are provided for use in removing Allen screws and other such fasteners with recessed heads such as Torx, square recess, Posidriv, clutch, Frearson and the like. If the screw is corroded such that it is "frozen" in the receiving surface sometimes the screw does not respond to the twisting motion of an L-shaped wrench. While a T-bar may be used with an Allen driver for additional force, sometimes there is insufficient clearance to use a T-bar. In these instances, the application of brute force on an L-shaped wrench may result in the driver camming out of the recessed head and damaging the screw such that the screw may need to be drilled out of the receiving surface.

While it is generally understood that applying an axial force on a screwdriver may aid in loosening a frozen screw, there has been no way to apply an axial force on an Allen wrench or other L-shaped wrench while simultaneously or subsequently applying a twisting motion.

BRIEF SUMMARY OF THE INVENTION

In view of the above, it is an object of the present invention to provide an L-shaped wrench with a hammer head for use in applying an axial and a torque force to a screw with a recessed head. It is another object to provide an L-shaped wrench for use in loosening frozen screws with recessed heads. Other objects and features of the invention will be in part apparent and in part pointed out hereinafter.

In accordance with the invention, an L-shaped wrench with a hammer head is disclosed. The wrench includes a handle and a shank attached to the head. The head includes first and second impact surfaces and first and second torque surfaces. The impact surfaces are perpendicular to the handle and the shank such that an impact force on the impact surfaces is transmitted axially along the handle and the shank respectively. The torque surfaces are parallel to each other such that the head may be gripped by a torque applying device.

In the embodiment illustrated in the drawings, the hammer head is hexahedral with the handle and the shank attached to adjacent surfaces with the head relieved between the adjacent surfaces for clearance of the tool in constricted work areas.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
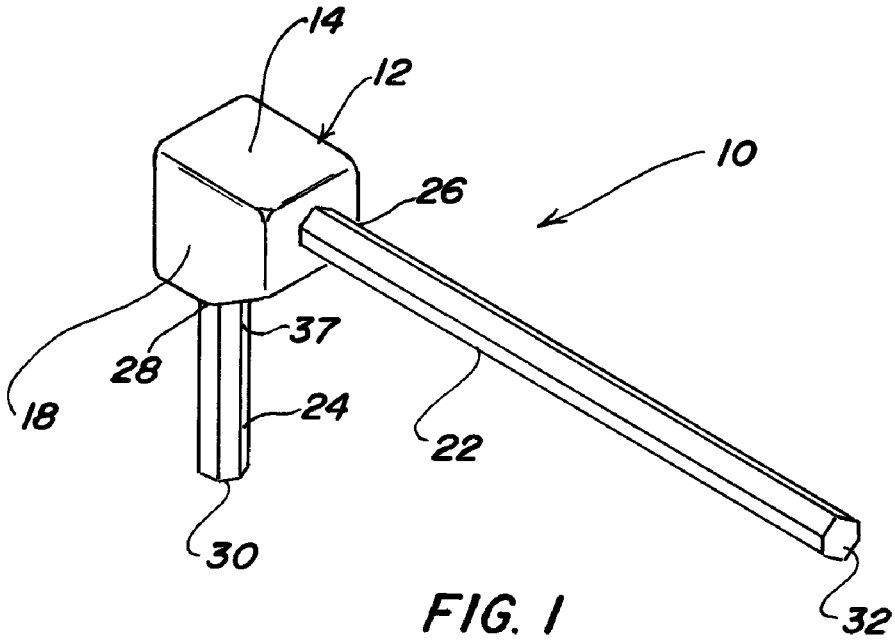
FIG. 1 is a perspective view of a hammer head Allen wrench in accordance with the present invention.

Referring to the drawings more particularly by reference character, a wrench 10 in accordance with the present invention has a hammer head 12 with first and second impact surfaces 14, 16, respectively and first and second torque surfaces 18, 20, respectively. A handle 22 extends laterally from head 12 and a shank 24 extends from a lower side of head 12. An inner end 26 of handle 22 and an inner end 28 of shank 24 are received in bores provided in head 12.

An outer end of shank 24 terminates with a driver 30 and an outer end of handle 22 terminates with a driver 32 for fasteners 34 having recessed heads. Wrench 10 as illustrated in the drawings is for Allen screws with recessed heads and drivers 30, 32 are hexagonal in cross-section. When wrench 10 is for use with screws having other heads such as slot, Phillips, Torx, square recess, Pozidrive, clutch, Frearson or the like, drivers 30, 32 are appropriately shaped for receipt in the head of the screw.

As shown in the drawings, handle 22 is longer than shank 24 and drivers 30, 32 are identical in cross section, in both diameter and shape. Those skilled in the art will readily appreciate that this permits shank 24 and handle 22 to reverse roles such that driver 32 on handle 22 contacts fastener 34 which may be out of reach of shorter shank 24.

First impact surface 14 is substantially perpendicular to shank 24 such that when impact surface 14 is struck vertically, the impact force is transmitted axially along shank 24 to driver 30 for use as more particularly described below. For the same reason, second impact surface 16 is substantially perpendicular to handle 22 such that when driver 32 on handle 22 contacts fastener 34 and when impact surface 16 is struck vertically, the impact force is transmitted axially along handle 22 to driver 32.

Hammer head 12 has a multisided circumference such that torque surfaces 18, 20 are generally parallel and may be gripped by an adjustable wrench 36 or other torque applying device. As shown in the drawings, torque surfaces 18, 20 are square but other configurations effecting a communication with torque applying device 36 are understood to be within the scope of the invention. In the form illustrated, impact surfaces 14, 16 are flats and torque surfaces 18, 20 are flats and head 12 is generally hexahedral with shank 24 and handle 22 occupying the other two flats. Hammer head 12 may be relieved at a corner 37 between the adjacent surfaces to which shank 24 and handle 22 are attached. Relief 37 may provide clearance in tight working areas.

Figure 2:
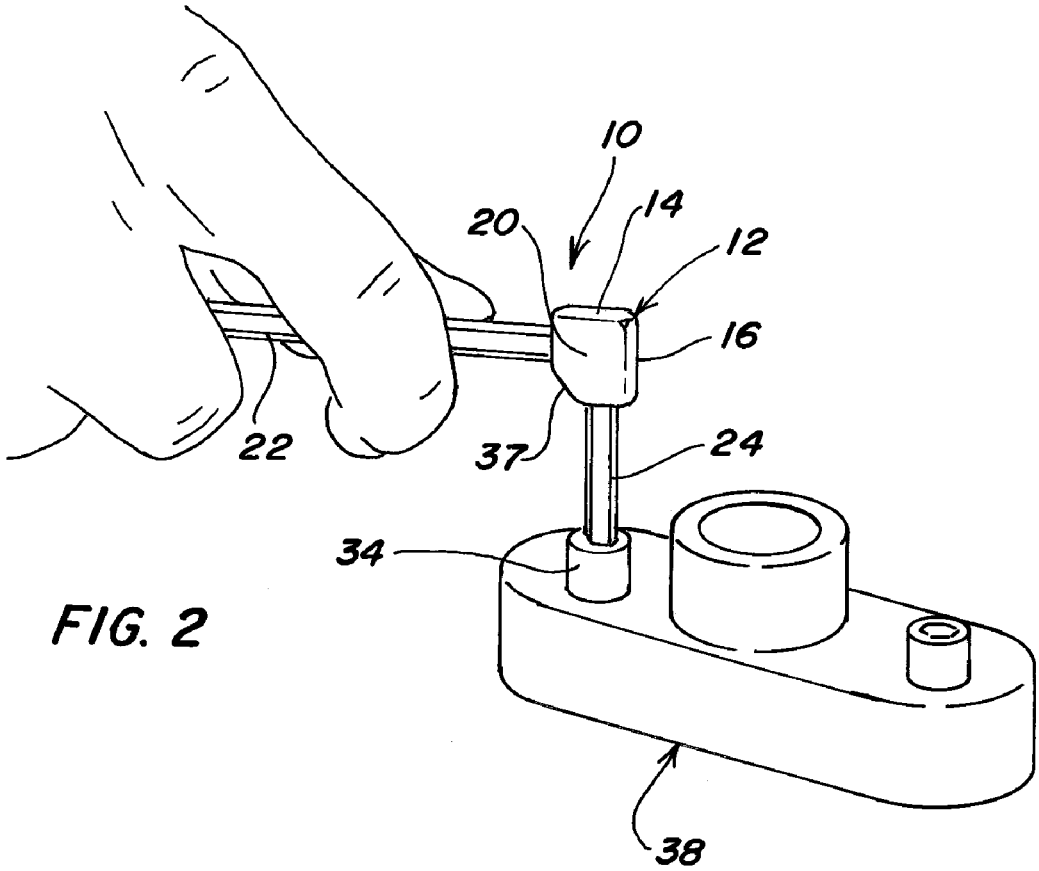
FIG. 2 is perspective view of the wrench in process of removing a screw which is frozen in a part.
Figure 3:
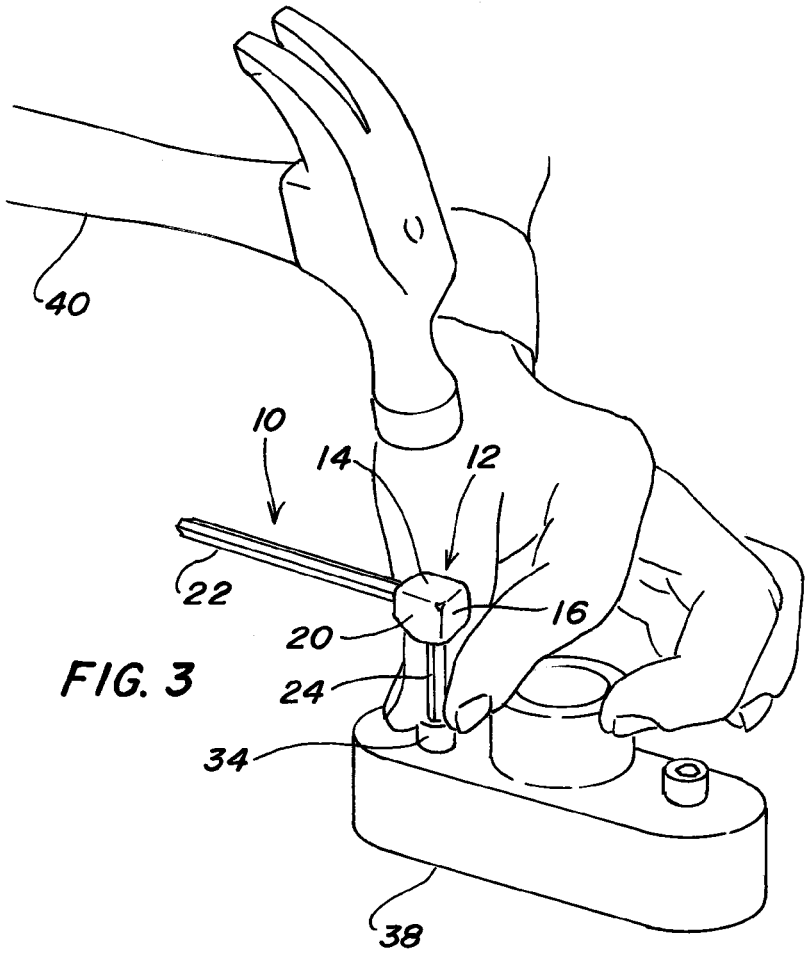
FIG. 3 is perspective view of the hammer head wrench about to be tapped by a hammer.
Figure 4:
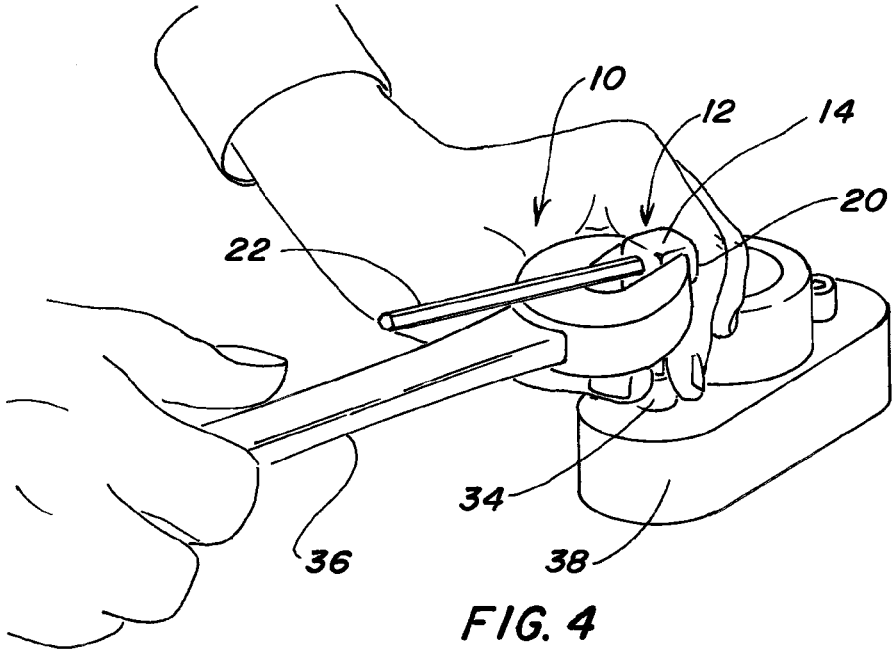
FIG. 4 is a perspective view of the hammer head being gripped by an open ended wrench from the handle side.
Figure 5:
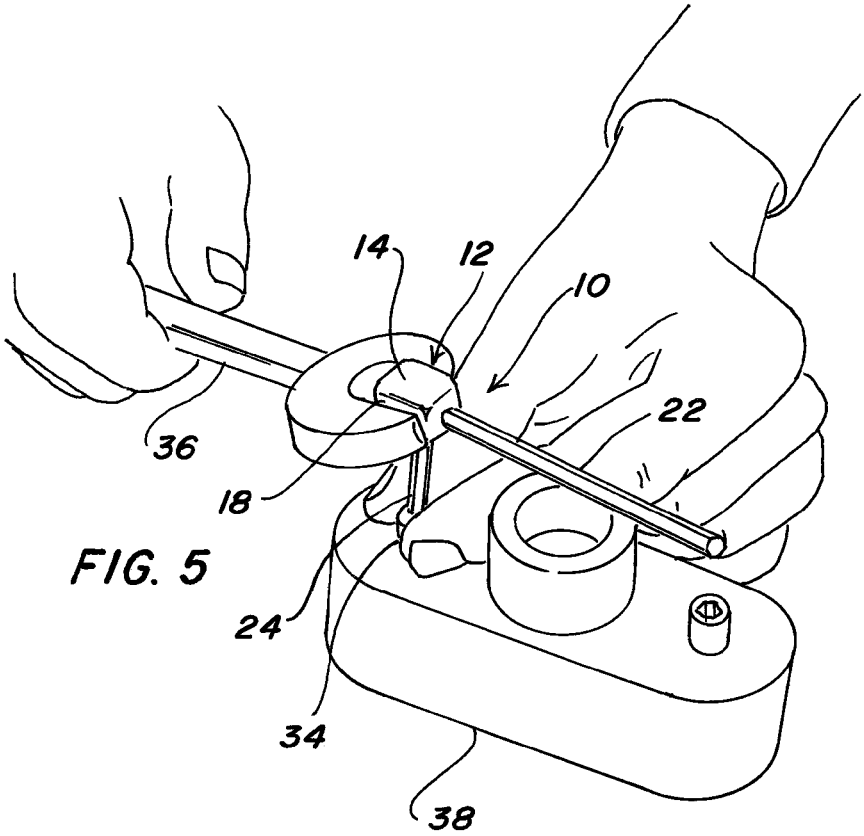
FIG. 5 is a perspective view of the hammer head being gripped by an open ended wrench opposite the handle side; and, FIG. 6 is a perspective view of the hammer head being gripped by an open ended wrench with the handle removed.
Figure 6:
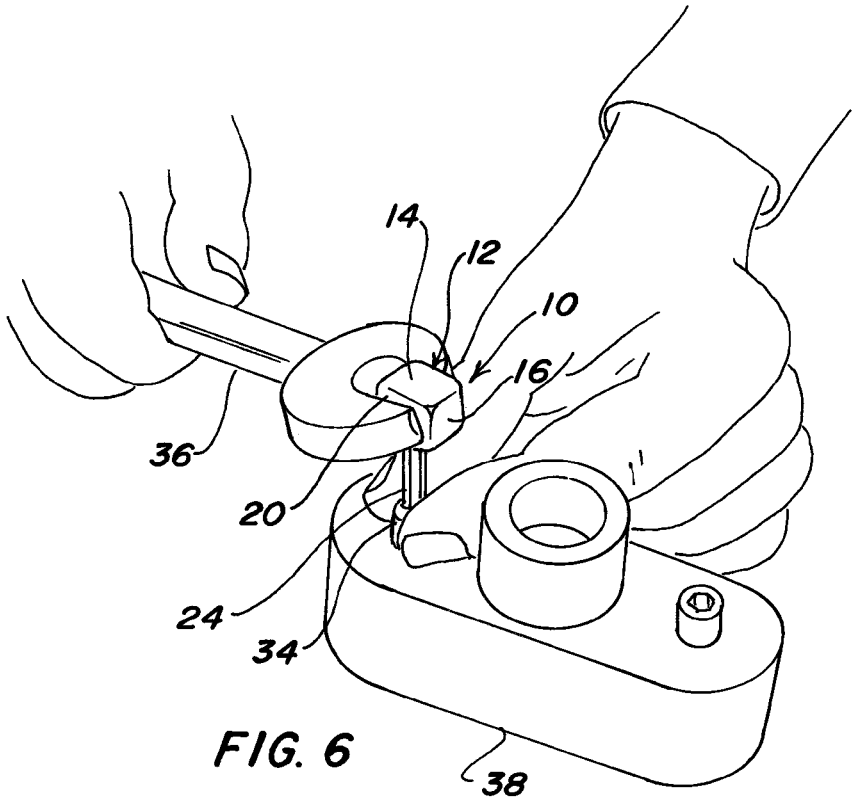

In use as shown in FIG. 2, wrench 10 is used in the manner of an ordinary Allen wrench when screws 34 are set in a metal workpiece 38. If screws 34 are frozen, first impact surface 14 may be tapped with a hammer 40 or load applying device to loosen the screw as shown in FIG. 3. As an alternative to tapping on screw 34 or after screw 34 has been tapped, additional twisting force may be applied on torque surfaces 18, 20 with a long handled tool such as open ended wrench 36. In FIG. 4, wrench 36 is shown gripping torque surfaces 18, 20 along handle 22 and as shown in FIG. 5, wrench 36 is shown gripping torque surfaces 18, 20 opposite handle 22. It will be understood that handle 22 and shank 24 may be detachable from hammer head 12 as shown in FIG. 6 depending on space requirements dictated by other parts surrounding screw 34 in workpiece 38.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. An L-shaped wrench comprising a handle and a shank having inner ends attached to a hammer head, said handle and shank having outer ends terminating in drivers for fasteners having a recessed head, said hammer head having first and second impact surfaces and first and second torque surfaces, said impact surfaces being perpendicular to a long axis of the handle and the shank such that an impact force on the impact surface is transmitted axially along the handle and the shank respectively, said torque surfaces being parallel to each other such that the hammer head may be gripped by a torque applying device.

2. The L-shaped wrench of claim 1 wherein the drivers are for Allen screws.

3. The L-shaped wrench of claim 2 wherein the handle is longer than the shank.

4. The L-shaped wrench of claim 1 wherein the handle and the shank are detachably attached to the hammer head.

* * * * *